US005686874A

United States Patent [19]

Piirainen

[11] Patent Number: 5,686,874

[45] Date of Patent: Nov. 11, 1997

[54] TEMPERATURE-COMPENSATED COMBINER

[75] Inventor: Risto Piirainen, Oulu, Finland

[73] Assignee: Nokia Telecommunications Oy, Espoo, Finland

[21] Appl. No.: 615,317

[22] PCT Filed: Jul. 17, 1995

[86] PCT No.: PCT/FI95/00404

§ 371 Date: Mar. 18, 1996

§ 102(e) Date: Mar. 18, 1996

[87] PCT Pub. No.: WO96/02952

PCT Pub. Date: Feb. 1, 1996

[30] Foreign Application Priority Data

Jul. 19, 1994 [FI] Finland ..... 943423

[51] Int. Cl.[6] ..... H01P 7/00

[52] U.S. Cl. ..... 333/234; 333/222; 333/224; 333/229

[58] Field of Search ..... 333/219, 222, 333/224, 226, 229, 234, 235, 231, 232

[56] References Cited

U.S. PATENT DOCUMENTS

| | | | |
|---|---|---|---|
| 2,077,800 | 4/1937 | Kroger . | |
| 2,998,582 | 8/1961 | Riblet . | |
| 4,251,754 | 2/1981 | Ranghelli et al. | 333/224 |
| 4,292,610 | 9/1981 | Makimoto et al. | 333/234 |
| 4,661,790 | 4/1987 | Gannon et al. | 333/234 |
| 4,726,071 | 2/1988 | Jachowski | 333/232 |

FOREIGN PATENT DOCUMENTS 2809363 11/1978 Germany .

*Primary Examiner*—Benny T. Lee
*Assistant Examiner*—Darius Gambino
*Attorney, Agent, or Firm*—Cushman Darby & Cushman Intellectual Property Group of Pillsbury Madison & Sutro LLP

[57] ABSTRACT

A temperature-compensated combiner including a control rod disposed in a combiner housing for controlling a middle frequency; a resonator tube secured to the housing and coaxially disposed around the control rod; a regulating cup arranged at an end of the control rod which faces the housing; a motor which controls the middle frequency and which is arranged at one end of the control rod; and a temperature-compensating tube for compensating for longitudinal changes exhibited by a unit including the control rod, the resonator tube and the regulating cup for changes in temperature. The temperature-compensating tube is positioned within the resonator tube and secured to that end of the resonator tube which faces the housing and to the frame of the motor. The regulating cup is fitted to the control rod with two sleeves which are positioned one within the other and made of different materials, a first sleeve being attached around the control rod to that end of the control rod which faces the regulating cup, and a second sleeve being attached to that end of the first sleeve which faces away from the regulating cup and to the regulating cup around the first sleeve. The sleeves form additional temperature-compensators, whereby the motor controlling the middle frequency can be positioned entirely within the resonator tube.

2 Claims, 1 Drawing Sheet

TEMPERATURE-COMPENSATED COMBINER

This application claims benefit of international application PCT/FI95/00404 filed Jul. 17, 1995.

BACKGROUND OF THE INVENTION

The present invention relates to a temperature-compensated combiner comprising a control rod disposed in a combiner housing for controlling the middle frequency; a resonator tube secured to the housing and coaxially disposed around the control rod; a regulating cup which is arranged at that end of the control rod which faces the housing and which is coaxial with the control rod and the resonator tube; a motor which controls the middle frequency and which is arranged at that end of the control rod which faces away from the combiner housing; and temperature-compensating means for compensating for longitudinal changes exhibited by a unit consisting of the control rod, the resonator tube and the regulating cup for changes in temperature. The temperature-compensating means comprises a temperature-compensating tube which moves the control rod in response to changes in temperature. The temperature-compensating tube is positioned within the resonator tube and secured to that end of the resonator tube which faces the housing and to the frame of the motor.

This type of solution, disclosed in Finnish Patent Application 934,630, (corresponding to U.S. patent application Ser. No. 08/632,399, filed Apr. 19, 1996) is designed to replace for instance the combiner manufactured by CELWAVE, where temperature compensation is implemented by a temperature-compensation device projecting from the exterior surface of the combiner housing, a significant drawback of this solution being that the combiner takes-up a lot of space. The combiner takes up an especially great amount of space when the combiner is made automatically controllable by connecting a motor, for instance a stepper motor, to the control rod.

In the solution according to Finnish Patent Application 934,630, however, it is difficult to position the motor in its entirety within the combiner housing, and thus, in practice, part of the motor still remains outside the housing.

SUMMARY OF THE INVENTION

The object of the present invention is to obviate the above-mentioned drawback. This is achieved with the type of combiner described above, characterized according to the invention in that the regulating cup is fitted to the control rod with two sleeves which are positioned one within the other and made of different materials, a first sleeve being attached around the control rod to that end of the control rod which faces the regulating cup, and a second sleeve being attached to that end of the first sleeve which faces away from the regulating cup and to the regulating cup around the first sleeve, these sleeves forming additional temperature-compensating means, whereby the motor controlling the middle frequency can be positioned entirely within the resonator tube.

The invention is based on the idea to use, in addition to the above-mentioned temperature-compensating tube, additional temperature-compensating means which are positioned one within the other and which expand in opposite directions in a different manner by the action of heat, whereby the control rod to be connected to the motor shaft can be shortened to such an extent that the motor can be positioned entirely within the resonator tube and thus within the entire combiner housing.

When the motor is positioned entirely within the combiner housing, it is significantly easier than before to position the combiner in a dedicated stand. At the same time, the increase in waste space is avoided.

BRIEF DESCRIPTION OF THE DRAWING

In the following, the invention will be described in more detail by means of one preferred embodiment with reference to the accompanying drawing, in which.

DETAILED DESCRIPTION

Figure 1:
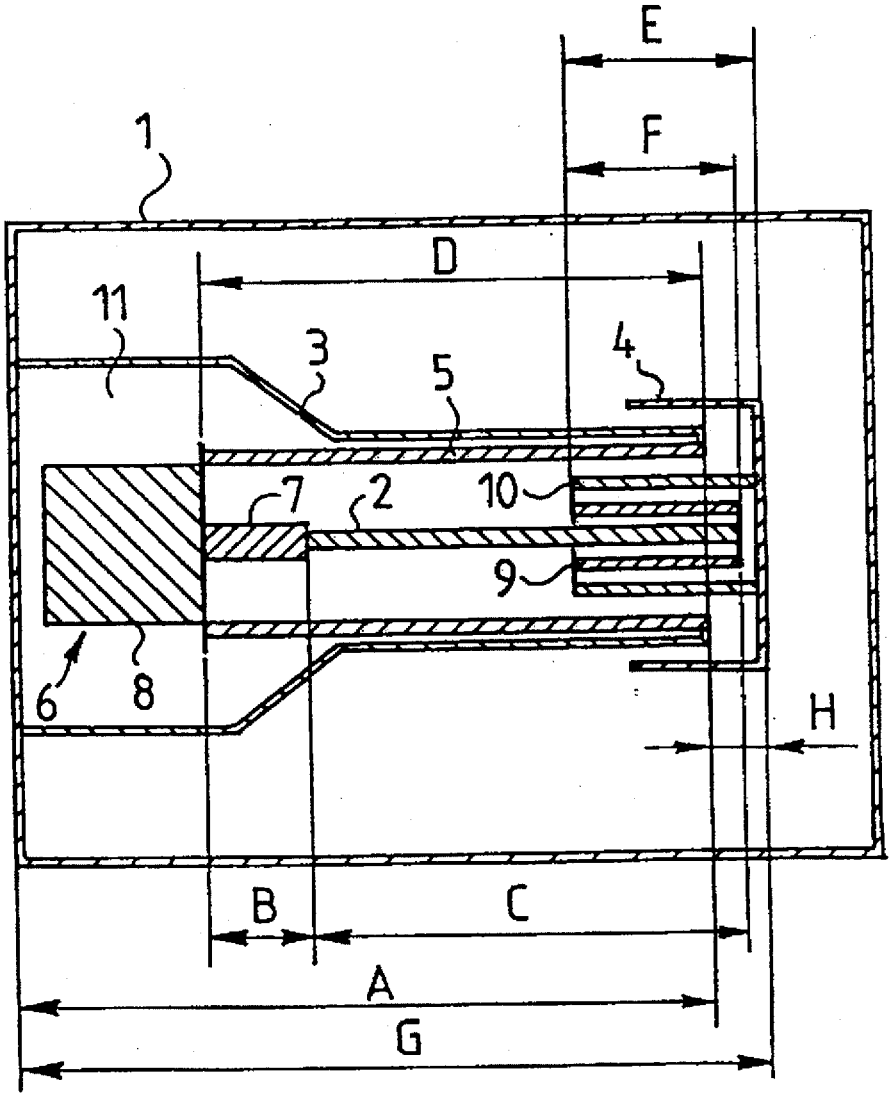
FIG. 1 is a simplified cross-section of the automatically controllable, temperature-compensated combiner of the invention.

The automatically controllable combiner shown in the drawing comprises a combiner housing 1; a control rod 2 for controlling the middle frequency, preferably made of a 36 weight percent Ni, 64 weight percent iron (ferronickel) steel alloy, the trademark of a source for which is Invar, and positioned within the housing 1; a resonator tube 3 preferably made of copper, attached to the housing 1 and coaxially arranged around the control rod 2; and a regulating cup 4 preferably made of copper, arranged at that end of the control rod 2 which faces the housing and coaxial with the control rod 2 and the resonator tube 3, the regulating cup being arranged to slide on the resonator tube 3.

The combiner also comprises a temperature-compensating tube 5 for compensating for longitudinal changes exhibited by the unit consisting of the control rod 2, the resonator tube 3 and the regulating cup 4 for changes in temperature, the temperature-compensating tube being disposed within the resonator tube 3 coaxially with the resonator tube and being attached to that end of the resonator tube 3 which faces the housing. This temperature-compensating tube 5 is preferably made of aluminum, but it can also be made of some other material, such as plastic. When the above-mentioned components disposed within the combiner housing 1 are dimensioned to be of a suitable length, changes in temperature do not essentially change the controlled middle frequency.

The combiner is made automatically controllable by a middle frequency-controlling stepper motor 6, attached at its shaft 7 to that end of the control rod 2 which faces away from the combiner housing 1, and at its frame 8 to the end of the temperature-compensating tube 5.

The regulating cup 4 is fitted to the control rod 2 with two sleeves 9 and 10 which are positioned one within the other and made of different materials, a first sleeve 9 being attached around the control rod 2 to that end of the control rod 2 which faces the regulating cup 4, and a second sleeve 10 being attached to that end of the first sleeve 9 which faces away from the regulating cup 4 and to the regulating cup 4 around the first sleeve 9. These sleeves 9 and 10 form additional temperature-compensating means, whereby the motor 6 controlling the middle frequency can be positioned entirely within the resonator tube 3, for instance in an extension 11 made thereto.

The following is an example of how the additional compensating means (sleeves 9 and 10) of the combiner of FIG. 1 can be dimensioned, and which raw materials can be selected, the total heat expansion exhibited by the structure for a change in temperature being minimized and it being possible to dispose the motor 6 entirely within the combiner housing 1.

Thus, the following is valid as regards the transition caused by heat expansion:

$$Y_F = k_1A+k_2B+k_3C+k_3E,$$

and the following as regards the compensating transition:

$$Y_R = k_4D+k_4F$$

In the equations, $k_{1,2}$ . . . is the heat expansion coefficient of the metal concerned, and A, B, . . . is the length of a part.

Since it is desirable, as regards the operation of the combiner, that the distance G of the regulating cup 4 from the edge of the housing 1 remain unchanged as the temperature changes, this is realized when $Y_F=Y_R$.

The structure can be designed in such a manner that E is almost the same as F. (In FIG. 1, E and F are of unequal length for the sake of clarity. This assumption has no significant meaning, and it can also be stated, corresponding to reality, for instance as follows: F=E+2 mm.) When F=E, the following is obtained:

$$k_1A+k_2B+k_3C+k_3E=k_4D+k_4F$$

$$E=(k_1A+k_2B+k_3C-k_4D)/(k_4-k_3)$$

The following are selected:

a resonator tube 2 which is 130 mm long and made of copper (dimension A), a stepper motor 6 shaft which is 20 mm long and made of stainless steel (dimension B), a control rod 3 which is 110 mm long and made of 36:64 nickel steel alloy (dimension C), a regulating cup 4 which is 75 mm long and made of aluminum (dimension D), an inner sleeve 9 made of aluminum (dimension F), and an outer sleeve 10 made of 36:64 nickel steel alloy (dimension E).

| | |
|---|---|
| $k_1 = 17 * 10^{-6}$ 1/k | for copper |
| $k_2 = 16 * 10^{-6}$ 1/k | for stainless steel |
| $k_3 = 0{,}8 * 10^{-6}$ 1/k | for 36:64 nickel steel alloy |
| $k_4 = 23{,}9 * 10^{-6}$ 1/k | for aluminum |

Dimension H is selected to be 5 mm, which is sufficient to be the clearance of the regulating cup 4.

With the above-mentioned dimensions, the value of E, and thus also F, will be 34 mm. Thus, the inner sleeve 9 consists of an 36:64 nickel steel alloy sleeve which is 34 mm long, and the outer sleeve 10 consists of an aluminum sleeve which is 34 mm long.

The invention has been described above by means of only one preferred embodiment thereof. One skilled in the art can, however, implement it in various alternative ways within the scope of the appended claims.

I claim:

1. A temperature—compensated resonator for controlling a middle frequency for a radio frequency transmitting system, comprising:

a cylindrical housing having an axially inner end, an axially outer end, and a peripheral sidewall extending in an axial direction from said outer end to said inner end;

a control rod disposed within the housing and arranged to control a middle frequency depending on adjustment spatial positioning of the control rod in said axial direction; said control rod having an inner end facing the inner end of said housing;

a resonator tube secured to the housing and coaxially disposed around the control rod; said resonator tube having an axially inner end facing the inner end of said housing;

a regulating cup having an end wall and a peripheral side wall; said cup being disposed within the housing between the inner end of the housing and the inner end of the control rod, and being cupped about said inner end of the control rod between said inner end of said control rod and said inner end of said housing; said cup being coaxial with said control rod and said resonator tube;

a motor disposed entirely within said resonator tube near said outer end of said housing and having a shaft connected to the control rod for adjusting spatial positioning of the control rod in said axial direction; said motor including a frame;

a temperature-compensating structure for compensating for longitudinal expansion and contraction in said axial direction, of a unit comprised of said control rod, said resonator tube and said cup; said temperature-compensating structure including:

a temperature-compensating tube arranged to move said control rod in said axial direction in response to changes in temperature; said temperature-compensating tube being positioned within said resonator tube and secured, at axially spaced sites thereon, to said inner end of said resonator tube and to said frame of said motor; and first and second telescopically coaxially related sleeves respectively made of different materials from one another, each having an axially inner end and an axially outer end; said first of said sleeves being disposed around said control rod and having said inner end thereof attached to said inner end of said control rod; and said second of said sleeves surrounding said first of said sleeves, having said inner end thereof attached to said cup, and having said outer end thereof attached to said outer end of said first sleeve.

2. The combiner of claim 1, wherein:

said temperature-compensating tube and said first sleeve are made of aluminum, and said second sleeve is made of 64:36 ferro-nickel allow steel.

* * * * *